United States Patent [19]

Watanabe et al.

[11] Patent Number: 5,037,104

[45] Date of Patent: Aug. 6, 1991

[54] THREAD-WOUND GOLF BALL

[75] Inventors: Yoichi Watanabe, Kodaira; Yoshinori Egashira, Saitama; Kazuyuki Takahashi, Yokohama; Seisuke Tomita, Tokorozawa, all of Japan

[73] Assignee: Bridgestone Corporation, Tokyo, Japan

[21] Appl. No.: 527,912

[22] Filed: May 24, 1990

[30] Foreign Application Priority Data

May 24, 1989 [JP] Japan ..... 1-131021

[51] Int. Cl.[5] ..... A63B 37/12

[52] U.S. Cl. ..... 273/35 R; 524/908; 260/998.14; 525/236; 525/237; 525/332.6

[58] Field of Search ..... 273/235 R; 525/236, 525/237, 332.6

[56] References Cited

U.S. PATENT DOCUMENTS 1,524,428 1/1925 Geer ..... 524/908
1,926,315 9/1933 Smith ..... 273/235 R
3,362,937 1/1988 Kent ..... 273/235
4,353,557 10/1982 Kajita et al. ..... 260/198.14

FOREIGN PATENT DOCUMENTS 1026254 4/1964 United Kingdom .
1012710 12/1965 United Kingdom .
1078198 8/1967 United Kingdom .
WO80/02509 1/1980 World Int. Prop. O. .

*Primary Examiner*—Allan M. Lieberman
*Attorney, Agent, or Firm*—Sughrue, Mion, Zinn, Macpeak & Seas

[57] ABSTRACT

In a thread-wound golf ball comprising a thread-wound core and a cover, the cover is formed of a vulcanized rubber composition comprising a base rubber containing at least 30% by weight of transpolyisoprene and has a vulcanizing sulfur content ratio between radially outer and inner half regions of from ½ to 4/1. Sufficient vulcanizing sulfur available throughout the cover renders the cover to be resistant to cut and shear so that the ball becomes durable.

12 Claims, 1 Drawing Sheet

THREAD-WOUND GOLF BALL

This invention relates to thread-wound golf balls having a balata cover, and more particularly, to thread-wound golf balls having improved durability, especially cut resistance and shear resistance.

BACKGROUND OF THE INVENTION

Thread-wound golf balls having a balata cover are well known in the art. They are generally manufactured by winding a length of thread of high quality natural rubber or synthetic rubber on a solid center of high repulsion synthetic rubber or a liquid center. The resulting thread-wound core is enclosed in a balata cover. The assembly is shaped in a mold through the application of heat and pressure to form dimples in the cover surface. Then the cover is vulcanized by an immersion or gas vulcanization methods. The immersion vulcanization method is to immerse the ball in a solution of a vulcanization accelerator. The gas vulcanization method is to maintain the ball in an atmosphere of a vulcanizing agent gas.

Many skilled players and professional golfers favor these thread-wound golf balls having a balata cover because they offer a pleasant feel upon hitting, improved directional control and spin properties so that they can be controlledly hooked or sliced.

The thread-wound golf balls having a balata cover, however, suffer from the problem that the cover is less resistant to cut and shearing (chipping and peeling) and thus less durable. It is thus desired to improve their durability, especially the cut and shear resistance of the cover.

SUMMARY OF THE INVENTION

Therefore, an object of the present invention is to provide a thread-wound golf ball having a balata cover which is fully durable, especially improved in cut and shear resistance of the cover.

The inventors have found that a thread-wound golf ball comprising a center, a thread rubber layer wound on the center, and a cover enclosing the thread-wound core is improved in durability, especially in cut and shear resistance of the cover when the cover is formed by shaping and vulcanizing a rubber composition comprising a base rubber containing at least 30% by weight of transpolyisoprene such that the cover has a vulcanizing sulfur content ratio S1/S2 within the range of from 0.5 to 4, especially from 0.8 to 3.5 wherein S1 is a vulcanizing sulfur content in a radially outer half region and S2 is a vulcanizing sulfur content in a radially inner half region of the cover.

More particularly, we examined balata covers of conventional thread-wound golf balls to find that during vulcanization of a cover in a ball manufacturing process, migration of sulfur occurred from the inside to the outside of the cover, resulting in a cover inside region having a substantially lower vulcanizing sulfur content than near the cover outside. Insufficient resilience was provided near the cover inside. Mainly because of this loss of internal resilience, the cover had poor cut resistance and shear resistance. Making investigations in light of this finding in order to obtain a balata cover having high cut resistance and shear resistance, we have found that when a balata cover in which at least 30% by weight of the base rubber is comprised of transpolyisoprene is formed so as to provide a vulcanizing sulfur content ratio S1/S2 within the range of from 0.5 to 4, preferably from 0.8 to 3.5 wherein S1 is a vulcanizing sulfur content in an outer half region of the cover disposed radially outward of a radial midpoint and S2 is a vulcanizing sulfur content in an inner half region of the cover disposed radially inward of the radial midpoint, a sufficient amount of vulcanizing sulfur is available near the cover inside to provide high resilience. Thus the cover is substantially improved in impact resistances including cut resistance and shear resistance.

According to the present invention, there is provided a thread-wound golf ball comprising a thread-wound core and a cover enclosing the core, wherein the cover is formed of a vulcanized rubber composition comprising a base rubber containing at least 30% by weight of transpolyisoprene, and the cover has a vulcanizing sulfur content ratio S1/S2 within the range of from 0.5 to 4 wherein provided that said cover is dividable into two radially outer and inner half regions, S1 is a vulcanizing sulfur content in the radially outer half region and S2 is a vulcanizing sulfur content in the radially inner half region.

BRIEF DESCRIPTION OF THE DRAWINGS

The above and other objects, features, and advantages of the present invention will be better understood from the following description taken in conjunction with the accompanying drawings, in which.

DESCRIPTION OF THE PREFERRED EMBODIMENTS

Figure 1:
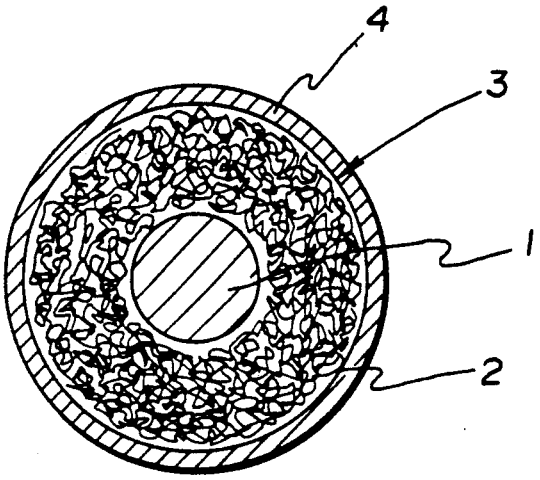
FIG. 1 is a schematic cross section of a thread-wound golf ball according to one embodiment of the invention.
Figure 2:
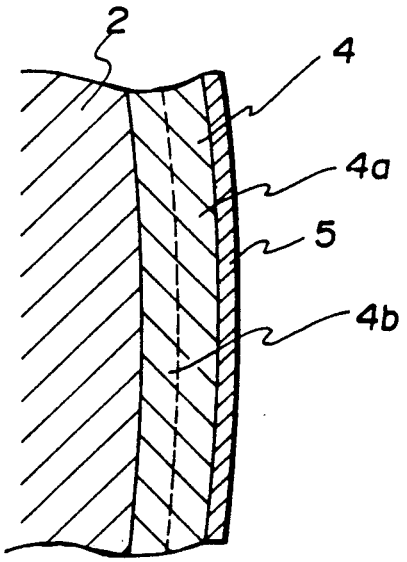
FIG. 2 is an enlarged cross section of a pertinent portion of the ball shown in FIG. 1.

Referring to FIG. 1, there is illustrated a thread-wound golf ball according to the present invention as comprising a thread-wound core 3 which is formed by winding a length of thread rubber 2 on a center 1. The core 3 is enclosed in a balata cover 4 onto which a lacquer coating 5 is generally applied as shown in FIG. 2.

The cover 4 is formed of a balata rubber composition comprising a base rubber containing at least 30% by weight of transpolyisoprene. The cover 4 has a vulcanizing sulfur content ratio S1/S2 within the range of from 0.5 to 4, preferably from 0.8 to 3.5. For the definition of vulcanizing sulfur contents S1 and S2, it is assumed that the cover 4 having a radial thickness is dividable into two radially outer and inner half regions, that is, an outer half region **4*a* of the cover disposed radially outward of a radial midpoint (corresponding to broken circle lines) and an inner half region 4*b* of the cover disposed radially inward of the radial midpoint as shown in FIG. 2. Then, S1 is a vulcanizing sulfur content in the radially outer half region 4*a* and S2 is a vulcanizing sulfur content in the radially inner half region 4*b***.

More particularly, the rubber composition of which the cover 4 is formed includes a base rubber containing at least 30% by weight, preferably 50 to 80% by weight of transpolyisoprene rubber and the balance of another rubber which may be selected from the group consisting of styrene-butadiene rubber, natural rubber, cis-polyisoprene rubber, and butadiene rubber. In addition to the base rubber, the rubber composition may include various well-known additives, for example, pigments, dyes, antioxidants, and lubricants, which may be blended in effective amounts as desired.

The golf ball of the invention is prepared by applying the above-defined rubber composition on a thread-wound core and vulcanizing to form a cover having a vulcanizing sulfur content ratio S1/S2 of from 0.5 to 4. The vulcanizing sulfur content ratio S1/S2 can be controlled to fall within the range between 0.5 and 4 by the following methods, for example.

(i)

A first method is by blending insoluble sulfur powder in the covering rubber composition, thereby suppressing the migration of sulfur during vulcanization reaction. The amount of insoluble sulfur blended herein is preferably 2 to 6 parts by weight per 100 parts by weight of the base rubber. In this case, ordinary (soluble) sulfur may additionally be blended into the base rubber such that the total sulfur amount ranges from 2 to 6 parts per 100 parts by weight of the base rubber, with the insoluble sulfur occupying 60 to 100% by weight of the total sulfur.

(ii)

A second method is by blending a sulfur-providing agent such as 4,4'-dithiodimorpholine and dipentamethylenethiuramtetrasulfide in the covering rubber composition and effecting vulcanization. The amount of sulfur-providing agent blended herein is preferably 1 to 4 parts by weight per 100 parts by weight of the base rubber. Also in this case, about 1 to 4 parts by weight of ordinary sulfur may be used per 100 parts by weight of the base rubber in addition to 0.5 to 4 parts by weight of the sulfur-providing agent.

If the vulcanizing sulfur content ratio S1/S2 is in excess of 4, then there results a cover inner half region 4*b* (FIG. 2) having a reduced degree of crosslinking and thus low resilience, failing to provide durability. If the vulcanizing sulfur content ratio S1/S2 is lower than 0.5, then there results a cover outer half region 4*a* (FIG. 2) having a reduced degree of crosslinking, also failing to provide durability.

The thread-wound core to be enclosed in the cover defined above may be either a liquid center core or a solid center core. The liquid center core, solid center core, and thread rubber used herein are formed of conventional well-known materials. More particularly, the liquid center's centerback, solid center, and thread rubber may be formed of natural rubber, cispolyisoprene rubber, butadiene rubber, or the like. The liquid of the liquid center may be water containing a specific gravity modifier such as $BaSO_4$ and $SiO_2$. Any conventional thread-wound cores may be suitably used.

The cover may be applied to the core by various conventional methods including injection molding and compression molding. Also, vulcanization may be effected by various conventional methods including immersion vulcanization and gas vulcanization under commonly used conditions, with the immersion vulcanization method being preferred. The cover may be provided with dimples in any desired pattern. The cover typically has a thickness of from 1.2 to 2.5 mm.

The present invention may be applied to any type of golf ball including small balls having a diameter of at least 41.15 mm and a weight of up to 45.92 g, and large balls having a diameter of at least 42.67 mm and a weight of up to 45.92 g.

EXAMPLE

Examples of the invention are given below by way of illustration and not by way of limitation.

EXAMPLE 1

To the covering rubber composition shown in Table 1 was added 2.0 parts by weight of dipentamethylenethiuramtetrasulfide. The covering rubber composition was formed into sheets of 2.5 mm thick. A thread-wound liquid center core was interposed between a pair of sheets. The assembly was compression molded into a thread-wound golf ball. The ball was vulcanized by immersing in an aqueous solution containing 1% by weight of pipecolin pipecolyldithiocarbamate as a vulcanization accelerator. A lacquer was then applied to the ball, obtaining a final ball product (large ball) having a weight of 45.5 grams and a diameter of 42.7 mm.

TABLE 1

| | Parts by weight |
|---|---|
| Base rubber | |
| Transpolyisoprene or balata | 70 |
| Histyrene resin | 10 |
| Natural rubber | 20 |
| Additives | |
| Silica | 10 |
| Zinc oxide | 10 |
| Titanium dioxide | 5 |
| Silane coupling agent | 1 |
| Sulfur | 1.5 |

The cover was stripped from the ball, sectioned in a thickness direction, and subjected to line analysis in a thickness direction by an X-ray microanalyzer to quantitatively determine vulcanizing sulfur contents. The vulcanizing sulfur content ratio S1/S2 was calculated to be 1.0. It is to be noted that the vulcanizing sulfur content of a sample was determined after free sulfur was removed by extracting the sample with acetone.

EXAMPLE 2

A thread-wound golf ball was prepared by the same procedure as in Example 1 except that 3.0 parts by weight of a sulfur mixture of 90% by weight of insoluble sulfur and 10% by weight of ordinary sulfur was used instead of the sulfur additive in Table 1 and the addition of dipentamethylenethiuramtetrasulfide to the covering rubber composition was omitted. The vulcanizing sulfur content ratio S1/S2 was similarly calculated to be 1.5.

EXAMPLE 3

A thread-wound golf ball was prepared by the same procedure as in Example 2 except that a sulfur mixture of 60% by weight of insoluble sulfur and 40% by weight of ordinary sulfur was used. The vulcanizing sulfur content ratio S1/S2 was similarly calculated to be 2.5.

Examples 4 and 5 are comparative examples outside the scope of the invention.

EXAMPLE 4

A thread-wound golf ball was prepared by the same procedure as in Example 1 except that the dipentamethylenethiuramtetrasulfide was omitted from the covering rubber composition. The vulcanizing sulfur content ratio S1/S2 was similarly calculated to be 5.0.

EXAMPLE 5

The rubber composition shown in Table 2 was formed into sheets of 1.25 mm thick. A thread-wound core as described in Example 1 was interposed between a pair of sheets. Further a pair of sheets of 1.25 mm thick prepared from the covering rubber composition shown in Table 1 were placed thereon. The assembly was compression molded into a thread-wound golf ball. The ball was vulcanized by the same method as in Example 1. A lacquer was then applied to the ball, obtaining a final ball product.

TABLE 2

| | Parts by weight |
|---|---|
| Base rubber | |
| Transpolyisoprene or balata | 70 |
| Histyrene resin | 10 |
| Natural rubber | 20 |
| Additives | |
| Silica | 10 |
| Zinc oxide | 10 |
| Titanium dioxide | 5 |
| Silane coupling agent | 1 |
| 90% insoluble sulfur/10% ordinary sulfur | 4 |

The vulcanizing sulfur content ratio S1/S2 of this ball was similarly calculated to be 0.4.

The thread-wound golf balls of Examples 1–5 were evaluated for cut resistance and shear resistance by the following methods.

Cut resistance

Balls were hit (top) using a hitting test machine of True Temper Co. with a No. 9 iron. The number of uncut balls was counted and expressed based on an index of 100 for Example 4.

Shear resistance

Balls were hit (normal) using a hitting test machine of True Temper Co. with a No. 9 furrow iron. The degree of shear was visually inspected and expressed based on an index of 100 for Example 4.

The results are shown in Table 3.

TABLE 3

| Example | 1 | 2 | 3 | 4* | 5* |
|---|---|---|---|---|---|
| S1/S2 | 1.0 | 1.5 | 2.5 | 5 | 0.4 |
| Cut index | 130 | 130 | 120 | 100 | 100 |
| Shear index | 140 | 130 | 115 | 100 | 100 |

*outside the scope of the invention

There has been described a thread-wound golf ball comprising a thread-wound core and a cover wherein the cover is formed of a vulcanized rubber composition comprising a base rubber containing at least 30% by weight of transpolyisoprene and the cover has a vulcanizing sulfur content ratio S1/S2 of from 0.5 to 4. Since sufficient vulcanizing sulfur is available throughout the cover, the cover has improved cut resistance and shear resistance. The ball as a whole is well durable.

Although some preferred embodiments have been described, many modifications and variations may be made thereto in the light of the above teachings. It is therefore to be understood that within the scope of the appended claims, the invention may be practiced otherwise than as specifically described.

We claim:

1. A thread-wound golf ball comprising a thread-wound core and a cover enclosing the core, wherein said cover is formed of a vulcanized rubber composition comprising a base rubber containing 30% to 80% by weight of transpolyisoprene and 70% to 20% by weight of at least one other rubber selected from the group consisting of styrene-butadiene rubber, natural rubber, cispolyisoprene rubber and butadiene rubber, and said cover has a vulcanizing sulfur content ratio S1/S2 within the range of from 0.5 to 4, wherein provided that said cover is dividable into two radially outer and inner half regions, S1 is a vulcanizing sulfur content in the radially outer half region and S2 is a vulcanizing sulfur content in the radially inner half region.

2. The golf ball of claim 1 wherein said cover has a vulcanizing sulfur content ratio S1/S2 within the range of from 0.8 to 3.5.

3. The golf ball of claim 1 wherein said base rubber contains 50 to 80% by weight of transpolyisoprene.

4. The golf ball of claim 1, wherein the rubber composition contains at least one additive selected from the group consisting of, a pigment, a dye, an antioxidant and a lubricant.

5. The golf ball of claim 1, wherein the thread-wound core is a liquid center core or a solid center core.

6. The golf ball of claim 5, wherein the liquid of the liquid center core is water containing a specific gravity modifier.

7. The golf ball of claim 6, wherein said gravity modifier is $BaSO_4$ and $SiO_2$.

8. The golf ball of claim 1, wherein the cover is applied to the core by injection molding or compression molding.

9. The golf ball of claim 1, wherein the rubber composition is vulcanized by immersion vulcanization or gas vulcanization.

10. The golf ball of claim 1, wherein the cover has a thickness of from 1.2 to 2.5 mm.

11. The golf ball of claim 1, wherein the golf ball is a small ball having a diameter of at least 41.15 mm and a weight of up to 45.92 g.

12. The golf ball of claim 1, wherein the golf ball is a large ball having a diameter of at least 42.67 mm and a weight of up to 45.92 g.

* * * * *